US010117296B1

(12) United States Patent
Zhao

(10) Patent No.: US 10,117,296 B1
(45) Date of Patent: Oct. 30, 2018

(54) LED STRAIGHT TUBE LAMPS

(71) Applicant: CH LIGHTING TECHNOLOGY CO., LTD., Shaoxing, Zhejiang Province (CN)

(72) Inventor: Guosong Zhao, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 15/694,734

(22) Filed: Sep. 1, 2017

(30) Foreign Application Priority Data

Jul. 18, 2017 (CN) ..... 2017 2 0874792 U

(51) Int. Cl.

| | |
|---|---|
| ***H05B 33/08*** | (2006.01) |
| ***F21K 9/272*** | (2016.01) |
| ***F21K 9/278*** | (2016.01) |
| ***H05B 33/06*** | (2006.01) |
| *F21Y 115/10* | (2016.01) |
| *F21Y 103/10* | (2016.01) |

(52) U.S. Cl.
CPC ..... *H05B 33/0815* (2013.01); *F21K 9/272* (2016.08); *F21K 9/278* (2016.08); *H05B 33/06* (2013.01); *F21Y 2103/10* (2016.08); *F21Y 2115/10* (2016.08)

(58) Field of Classification Search
CPC .... H05B 33/0185; H05B 33/02; H05B 33/06; H05B 33/08; H05B 33/0803; H05B 33/0806; H05B 37/02; H05B 33/0815; F21K 9/20; F21K 9/27; F21K 9/272
See application file for complete search history.

(56) References Cited

U.S. PATENT DOCUMENTS

| | | | | |
|---|---|---|---|---|
| 8,272,764 | B2 * | 9/2012 | Son | F21V 3/02 362/294 |
| 9,341,359 | B1 * | 5/2016 | Fernandez | H05B 37/0272 |
| 2012/0181952 | A1 * | 7/2012 | Roeer | H05B 33/0809 315/307 |
| 2012/0313540 | A1 * | 12/2012 | Lin | H05B 33/0884 315/201 |
| 2013/0320869 | A1 * | 12/2013 | Jans | H05B 33/0803 315/186 |

(Continued)

*Primary Examiner* — Jason M Crawford
(74) *Attorney, Agent, or Firm* — Jiwen Chen

(57) ABSTRACT

The invention involves a kind of LED straight tube lamp and it falls into the field of lighting technology. The LED straight tube lamp includes a tube, lamp caps that come with contact pins and are located on both ends of the tube, a first rectifying unit and a second rectifying unit that are coupled with the pins on the two ends respectively, a filter unit, and a switch unit that's located between the rectifying unit and the filter unit. The switch unit has sampling end that is coupled with either or both pins. When the pin on either end of LED straight tube lamp is connected to a power supply, if the external impedance of the pin on the other end is equal to or higher than its set value, the switch unit will be disconnected; if it is lower than the set value, the switch unit will be closed. One may effectively increase the safety of LED straight tube lamp in use by measuring the external impedance of the pin on the other end to see if the pin is correctly plugged in the lamp base so as to prevent any risk of electric shock resulted from contact between human body and the pin.

3 Claims, 2 Drawing Sheets

(56) References Cited

U.S. PATENT DOCUMENTS

| | | | | |
|---|---|---|---|---|
| 2014/0265900 | A1* | 9/2014 | Sadwick | H05B 33/0803 315/200 R |
| 2015/0181661 | A1* | 6/2015 | Hsia | F21V 25/04 315/160 |
| 2016/0091147 | A1* | 3/2016 | Jiang | F21V 3/061 315/205 |
| 2016/0219672 | A1* | 7/2016 | Liu | F21K 9/27 |
| 2017/0013688 | A1* | 1/2017 | Hsia | F21K 9/66 |
| 2017/0079100 | A1* | 3/2017 | Park | H05B 33/0815 |
| 2017/0094746 | A1* | 3/2017 | Xiong | H05B 33/0887 |
| 2017/0171937 | A1* | 6/2017 | Hsia | H05B 33/0887 |
| 2017/0370534 | A1* | 12/2017 | Xiong | F21V 3/061 |

* cited by examiner

LED STRAIGHT TUBE LAMPS

This application claims the priority benefit of Chinese Application No. 201720874792.4, filed Jul. 18, 2017 in Chinese, which is hereby incorporated by reference.

TECHNICAL FIELD

The present invention involves the field of LED lighting technology, particularly a kind of LED straight tube lamp.

BACKGROUND TECHNOLOGY

Due to advantages such as energy-saving, environmental-friendly and so on, LED lamps are gradually taking the place of traditional fluorescent lamps. A LED straight tube lamp usually comprises a tube, lamp caps and an internal drive circuit, wherein the main function of drive circuit is to convert the input alternating current into constant direct current. Traditional fluorescent lamps have electricity coming in from both ends. In order to fit into the mounting bracket of traditional fluorescent tube, the LED tubes now available also have corresponding double-ended power input structure. In the case of double-ended power input structure, when either end is properly installed and turned on, the operating personnel who touch the other end will be facing the risk of electric shock.

In order to avoid the risk mentioned above, Chinese Patent Application CN106224805A is a kind of lamp cap that comes with its own switch, including a cylindrical shell, in which one end is open and slipping over the lamp tube while the other end is closed and equipped with pins that are connected with the lamp's drive power; the lamp cap described is fitted with microswitch that controls the power on/off of driving power; fitted with a removable button that's used to trigger the microswitch described, which protrudes from the closed end of the cylindrical shell described. The patent application controls the power on/off of lamp tube with a mechanical switch and its structure is very complicated. Besides, it may easily lead to false trigger due to elastic failure after being used for a long time.

SUMMARY OF THE INVENTION

The present invention provides a LED straight tube lamp to solve the problem caused by complicated structure of traditional mechanical switch and ease of false triggering.

A kind of LED straight tube lamp that comprises a tube, lamp caps with contact pins and located on both ends of the tube, a first rectifying unit and a second rectifying unit that are coupled with the pins on the two ends respectively, a filter unit, and a switch unit that is located between the rectifying unit and the filter unit. The switch unit has a sampling end that is coupled with either or both pins. When the pin on either end of LED straight tube lamp is connected to mains supply, if the external impedance of the pin on the other end is equal to or higher than its set value, the switch unit will be disconnected; if it is lower than the set value, the switch unit will be closed.

During the working process, under the circumstances that the pin on one end is correctly plugged in a corresponding lamp cap while the pin on the other end is not, the external impedance of the other end is infinite; and when the pin on the other end that is not correctly plugged in comes into contact with human body, the external impedance equals to body impedance, i.e. when it is detected that the external impedance of the other end is equal to or higher than the preset value, it will cut off the connection between the rectifying unit and filter unit by disconnecting the switch unit, thereby stop the alternating current from flowing through the entire tube in order to prevent human body from touching the pin on the other end and cause any danger. When it is detected that the external impedance of the other end is lower than the preset value, it will connect the rectifying unit with the filter unit by closing the switch unit, thereby enable the lamp tube to function properly. Thus, it may estimate whether the entire LED straight tube lamp is correctly installed by detecting the external impedance of the pin on the other end, and it can prevent the pin from causing any harm to human body by contact. Not only does replacing traditional mechanical switch structure with circuit detecting system simplify the structure of the entire system that prevents human body from getting electric shock, it also solves the problem of easy false triggering.

The specific scheme is that the switch unit has both a first end and a second end, among which the first end is earthed and the second end is coupled with the filter unit.

The even more specific scheme is that the switch unit comprises a rectifying module, a reference module, an impedance detecting module, a control module, a driver module and a transistor. The transistor's source electrode and drain electrode are connected with the switch unit's first end and second end, respectively. The sampling end outputs sampling signal to the rectifying module, which outputs rectified sampling signal to the reference module. The impedance detecting module is used to detect the current on the switch unit's first end. The control module is used to compare the current detected by impedance detecting module and the current outputted by the reference module and export control signal to the driver module. The driver module outputs high-low level signal to the grid of the transistor.

The even more specific scheme is that the rectifying module is a semi-wave rectifying module.

The optimum scheme is that the external impedance is 500~1500 Ohm.

SPECIFIC EMBODIMENTS OF THE INVENTION

Figure 1:
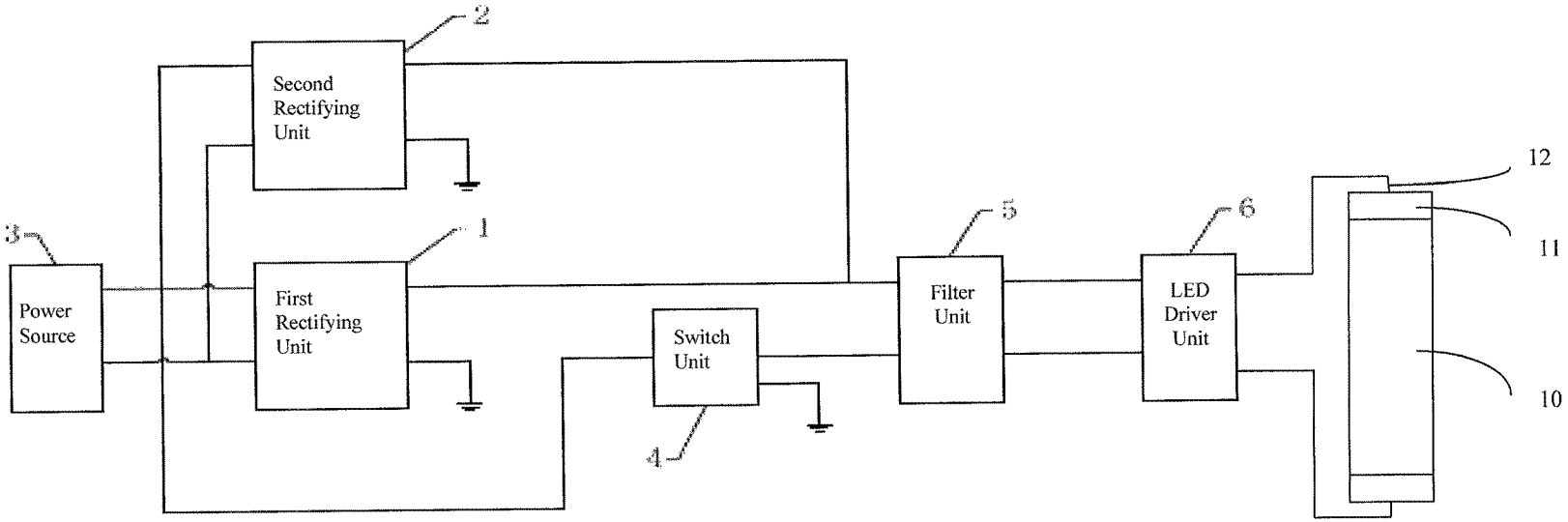
FIG. 1 is the principle diagram of the circuit in the embodiment of the present invention.

With reference to FIG. 1 the LED straight tube lamp described in the present invention comprises a tube 10, lamp caps 11 with contact pins 12 and located on both ends of the tube, a first rectifying unit 1 and a second rectifying unit 2 that are coupled with the pins on the two ends respectively, a filter unit 5, a LED driver unit 6, and a switch unit 4 that is located between the rectifying unit and the filter unit 5.

The first rectifying unit 1 is connected with the lamp base through the pin on one end of the tube and with a power source 3 through the power port in the lamp base. The second rectifying unit 2 is connected with the other lamp base through the pin on other end of the tube and with the power source 3 through the power port in the lamp base, thereby converts the output AC electric signal of the power source 3 into DC electric signal.

The first rectifying unit 1 and second rectifying unit 2 output DC electric signal to the filter unit 5, which outputs filtered electric signal to the LED driver unit 6. The driver layout of the LED driver unit 6 gives out LED light in the tube.

Figure 2:
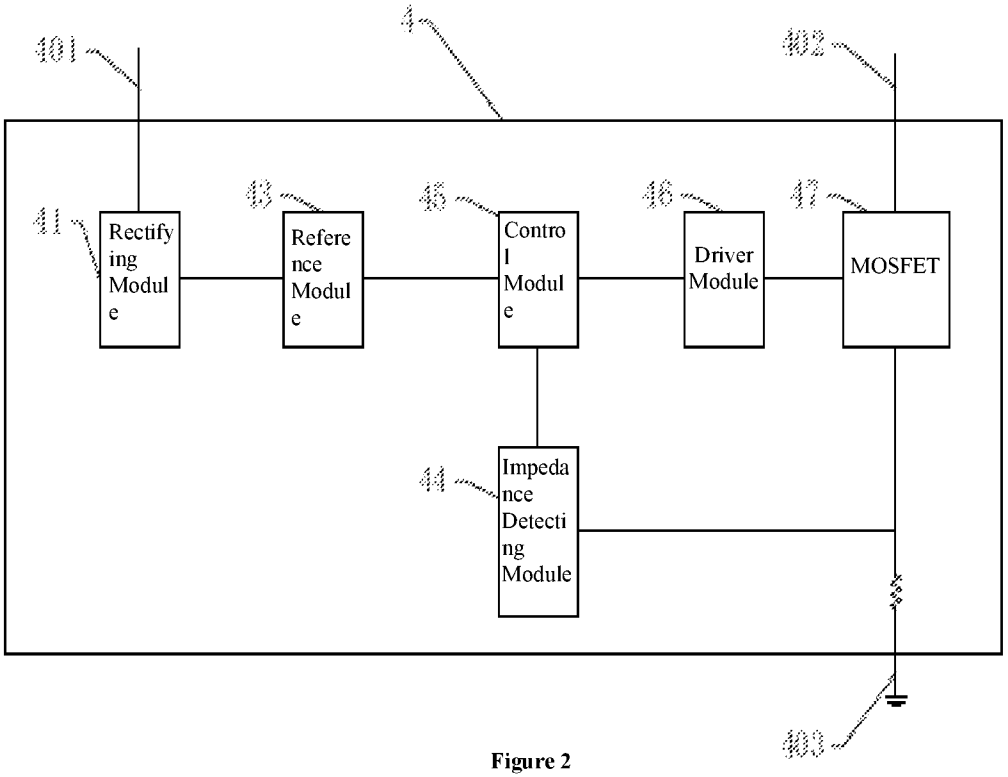
FIG. 2 is the principle diagram of the circuit of the switch unit in the embodiment of the present invention.

See FIG. 2. The switch unit 4 comprises a rectifying module 41, a reference module 43, an impedance detecting module 44, a control module 45, a driver module 46 and a transistor 47. Its first end 402 is coupled with the filter unit 5, a second end 403 is earthed and a third end is connected with a mains supply 3 via its sampling end.

The input end of the rectifying module 41 is connected with the third end 401, i.e. used to receive AC electric signal collected at the power source 3 by sampling end. The connection between sampling end and the power source 3 is coupled with the pin on either end of the tube or coupled with pins on both ends; the sampling end outputs the AC electric signal it collects to the rectifying module 41, which outputs rectified sampling signal to the reference module 43. In this embodiment, the rectifying module 41 is a semi-wave rectifying module composed of diodes.

The reference module 43 gathers reference current signal that serves as the benchmark according to the DC electric signal outputted by the rectifying module 41 and outputs it to the control module 45.

The drain electrode of the transistor 47 is coupled with the filter unit 5 through the first end 402, the source electrode is earthed via the second end 402, and the grid is coupled with the driver module 46.

The impedance detecting module 44 is coupled with the second end 402, thereby acquires the current that flows into the second end 402. When one end of the tube is correctly mounted to the lamp base while the other end is not or in contact with human body, the external impedance on the other end of the tube is relatively higher, which makes the current on the second end 402 lower than the current when both ends are correctly plugged in, i.e. the current information on the second end 402 contains the information of the external impedance on the other end of the tube.

The control module 45 is used to compare the current detected by the impedance detecting module 44 and the output current of the reference module 43. When the other end of the tube is correctly plugged in, the current detected by the impedance detecting module 44 is equal to or higher than the output current of reference module 43, the control module 45 outputs control signal to the driver module 46, which outputs high-level signal to the transistor 47, thereby connects the first end 402 with the second 403 and enables the entire tube to function properly; whereas, the control driver module 46 outputs low-level signal, thereby disconnects the first end 402 from the second end 403 and makes the entire tube unable to work properly, and prevents those who touch the other end of the tube from getting any electric shock at the same time.

The invention claimed is:

1. A LED straight tube lamp comprising a tube, lamp caps with contact pins and located on both ends of the tube, a first rectifying unit and a second rectifying unit and a filter unit that are coupled with the pins on the two ends respectively, and a switch unit that is located between the rectifying units and the filter unit characterized in that the switch unit comprises:

a sampling end that is coupled with either one or both of the contact pins, a first end that is earthed, and a second end that is coupled with the filter unit;

wherein the switch unit further comprises a rectifying module a reference module, an impedance detecting module, a control module, a driver module and a transistor;

a source electrode and a drain electrode of the transistor are connected with the first end and second end of the switch unit, respectively;

the sampling end outputs sampling signal to the rectifying module, which outputs rectified sampling signal to the reference module;

the impedance detecting module is used to detect the current on the switch unit's first end; the control module is used to compare the current detected by the impedance detecting module and the current outputted by the reference module and output control signal to the driver module; the driver module outputs high-low level signal to the grid of the transistor; and wherein when the contact pin on either end of the LED straight tube lamp is connected to a power supply, if the current detected by the impedance detecting module is lower than a set value, the switch unit will be disconnected; if current detected by the impedance detecting module equal to or higher than the set value, the switch unit will be connected.

2. The LED straight tube lamp described in claim 1 wherein the rectifying module described is a semi-wave rectifying module.

3. The LED straight tube lamp described in claim 1 wherein an impedance detected by the impedance detecting module is 500~1500 Ohm.

* * * * *